US010625829B2

(12) United States Patent
Araki et al.

(10) Patent No.: US 10,625,829 B2
(45) Date of Patent: Apr. 21, 2020

(54) PERSONAL WATERCRAFT

(71) Applicant: KAWASAKI JUKOGYO KABUSHIKI KAISHA, Kobe-shi, Hyogo (JP)

(72) Inventors: Toshio Araki, Kakogawa (JP); Hironori Kato, Kakogawa (JP); Tadao Minesaki, Akashi (JP); Minoru Kanamori, Rowland Heights, CA (US)

(73) Assignee: KAWASAKI JUKOGYO KABUSHIKI KAISHA, Kobe-shi, Hyogo (JP)

( * ) Notice: Subject to any disclaimer, the term of this patent is extended or adjusted under 35 U.S.C. 154(b) by 0 days.

(21) Appl. No.: 16/110,141

(22) Filed: Aug. 23, 2018

(65) Prior Publication Data

US 2020/0062352 A1 Feb. 27, 2020

(51) Int. Cl.
*B63B 35/81* (2006.01)

(52) U.S. Cl.
CPC ..... *B63B 35/81* (2013.01)

(58) Field of Classification Search
CPC ..... B63B 35/81
See application file for complete search history.

(56) References Cited

U.S. PATENT DOCUMENTS 6,145,458 A * 11/2000 Hattori ..... B63B 29/04 114/55.57
6,244,916 B1 * 6/2001 Asakura ..... B63B 11/04 114/55.53
6,530,336 B2 * 3/2003 Ibata ..... B63B 25/002 114/55.5
8,505,475 B2 * 8/2013 Otsuka ..... B63B 49/00 114/55.5
2001/0018884 A1 * 9/2001 Maeda ..... B63B 35/731 114/55.57
2003/0127033 A1 * 7/2003 Nakagawa ..... B63B 25/002 114/55.57
2004/0007167 A1 * 1/2004 Cassell ..... B63B 17/00 114/55.57
2004/0031428 A1 * 2/2004 Prevost ..... B63B 1/125 114/55.57
2009/0107377 A1 * 4/2009 Duquette ..... B63B 35/731 114/55.57
2009/0107379 A1 * 4/2009 Duquette ..... B63B 3/48 114/55.57
2009/0107380 A1 * 4/2009 Duquette ..... B63B 35/731 114/55.57

(Continued)

*Primary Examiner* — S. Joseph Morano
*Assistant Examiner* — Jovon E Hayes
(74) *Attorney, Agent, or Firm* — Alleman Hall Creasman & Tuttle LLP

(57) ABSTRACT

A personal watercraft comprises a body including a deck; and a seat disposed on the deck at a location that is forward of a rear end of the deck, wherein the deck includes a deck floor extending in a forward and rearward direction and in a rightward and leftward direction, at a location that is lateral of the seat, and wherein when viewed from a side, inclined parts which are inclined in an upward direction from a front to a rear, are provided in regions of the deck floor, the regions vertically overlapping with a portion of the seat, the portion being rearward of a center of the seat in the forward and rearward direction.

6 Claims, 4 Drawing Sheets

(56) References Cited

U.S. PATENT DOCUMENTS

| | | | | |
|---|---|---|---|---|
| 2009/0139437 | A1* | 6/2009 | Simard | B63B 35/731<br>114/55.57 |
| 2009/0158982 | A1* | 6/2009 | Ross | B63B 25/002<br>114/55.57 |
| 2009/0194010 | A1* | 8/2009 | Spade | B63B 35/731<br>114/55.57 |
| 2011/0088607 | A1* | 4/2011 | Kobayashi | B63B 35/731<br>114/55.57 |
| 2013/0068149 | A1* | 3/2013 | Ruan | B63B 35/7943<br>114/55.57 |

* cited by examiner

PERSONAL WATERCRAFT

BACKGROUND OF THE INVENTION

Field of the Invention

The present invention relates to a personal watercraft which ejects a water jet of water taken into a body thereof to plane on a water surface, in a state in which a person (rider and/or passenger or the like) is seated on a seat provided on a deck.

Description of the Related Art

For example, U.S. Pat. No. 6,530,336 discloses a personal watercraft which ejects a water jet of water taken into a body thereof to plane on a water surface. In the personal watercraft, typically, a person (rider and/or passenger or the like) is seated on a seat in a state in which the person sees a forward side. In some cases, a player enjoys water sport such as wakeboarding by utilizing the personal watercraft. In these cases, for example, a monitoring person (observer) who monitors (observes) the player (hereinafter will be simply referred to as "monitoring person") is required to be seated on a rear portion of a seat placed on a deck of the body, in a state in which the monitoring person sees a rearward (backward) side.

In this case, for example, if an attempt is made to provide at the seat a structure for allowing the monitoring person to be stably seated on the seat according to acceleration or deceleration, or operation of the personal watercraft so that the monitoring person can properly monitor the player, this structure may become complicated.

SUMMARY OF THE INVENTION

In view of the above-described circumstances, an object of the present invention is to provide a personal watercraft with a relatively simple structure for allowing a monitoring person who monitors a player to be stably seated on a rear portion of a seat in a state in which the monitoring person sees a rearward (backward) side, in a case where the player plays water sport such as wakeboarding by utilizing the personal watercraft.

According to an aspect of the present invention, a personal watercraft comprises a body including a deck; and a seat disposed on the deck at a location that is forward of a rear end of the deck, wherein the deck includes a deck floor extending in a forward and rearward direction and in a rightward and leftward direction, at a location that is lateral of the seat, and wherein when viewed from a side, inclined parts which are inclined in an upward direction from a front to a rear, are provided in regions of the deck floor, the regions vertically overlapping with a portion of the seat, the portion being rearward of a center of the seat in the forward and rearward direction.

In accordance with this configuration, the monitoring person can keep the feet firmly fixed on the inclined parts of the deck floor, in a state in which the monitoring person is seated on a portion of the seat, the portion being rearward of the center of the seat in the forward and rearward direction, and sees a rearward (backward) side. Thus, with a relatively simple structure, the feet of the monitoring person can be supported and the posture of the monitoring person can be kept, according to the acceleration or deceleration, or operation of the personal watercraft. The monitoring person can be stably seated on the seat.

The above and further objects, features and advantages of the present invention will more fully be apparent from the following detailed description of preferred embodiment with reference to the accompanying drawings.

DETAILED DESCRIPTION OF THE PREFERRED EMBODIMENTS

Figure 1:
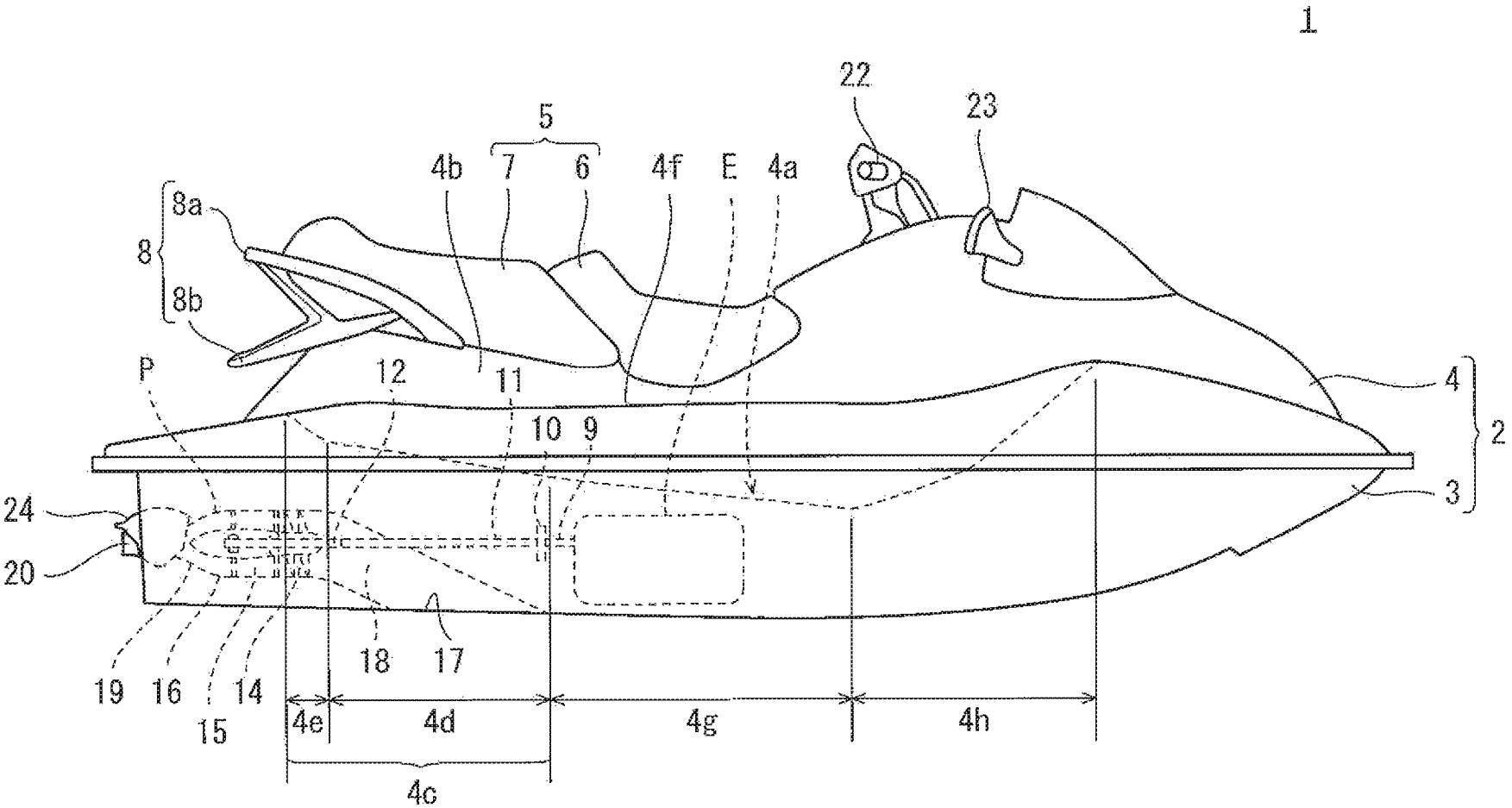
FIG. 1 is a side view of a personal watercraft according to an embodiment.
Figure 2:
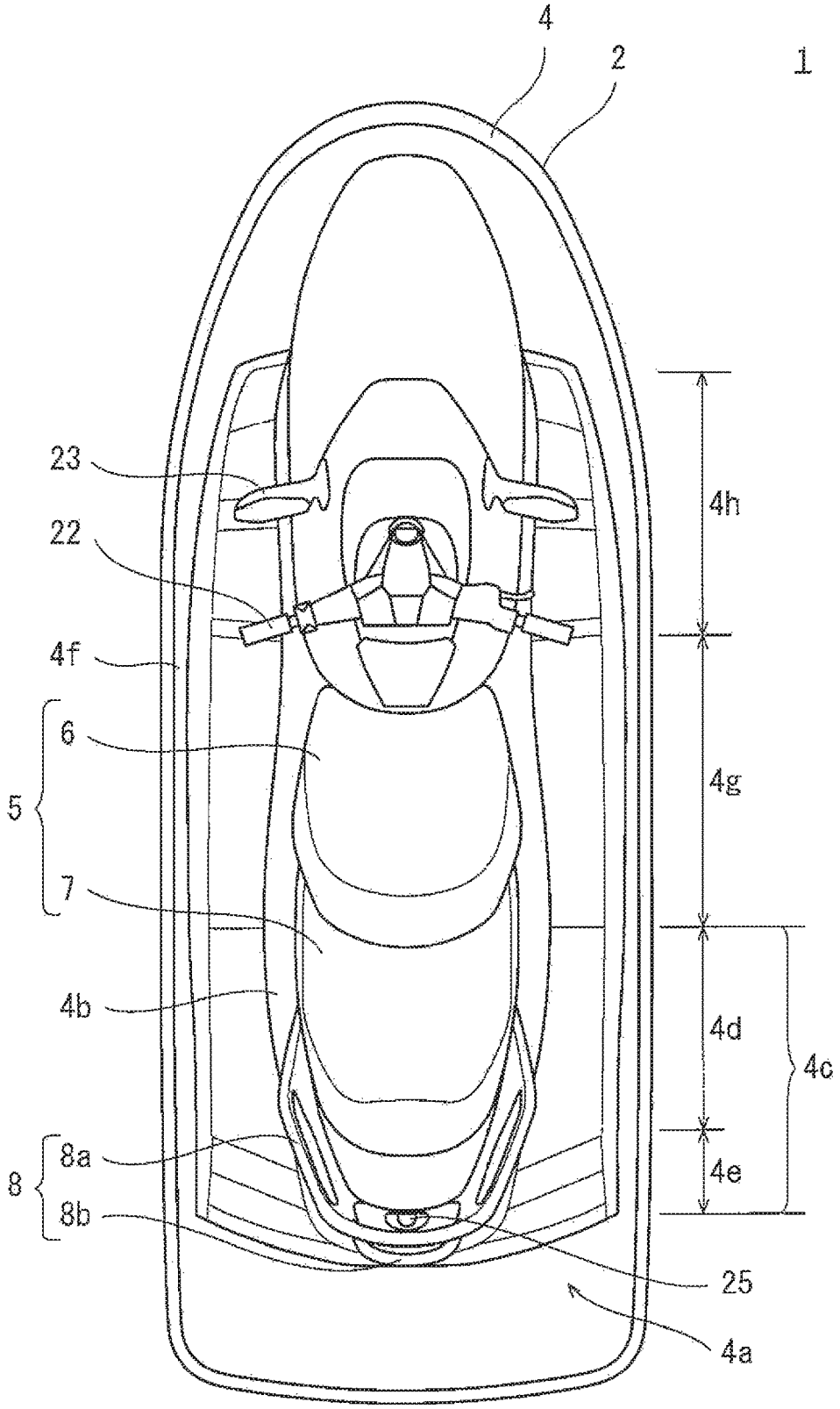
FIG. 2 is a top plan view of the personal watercraft of FIG. 1.
Figure 3:
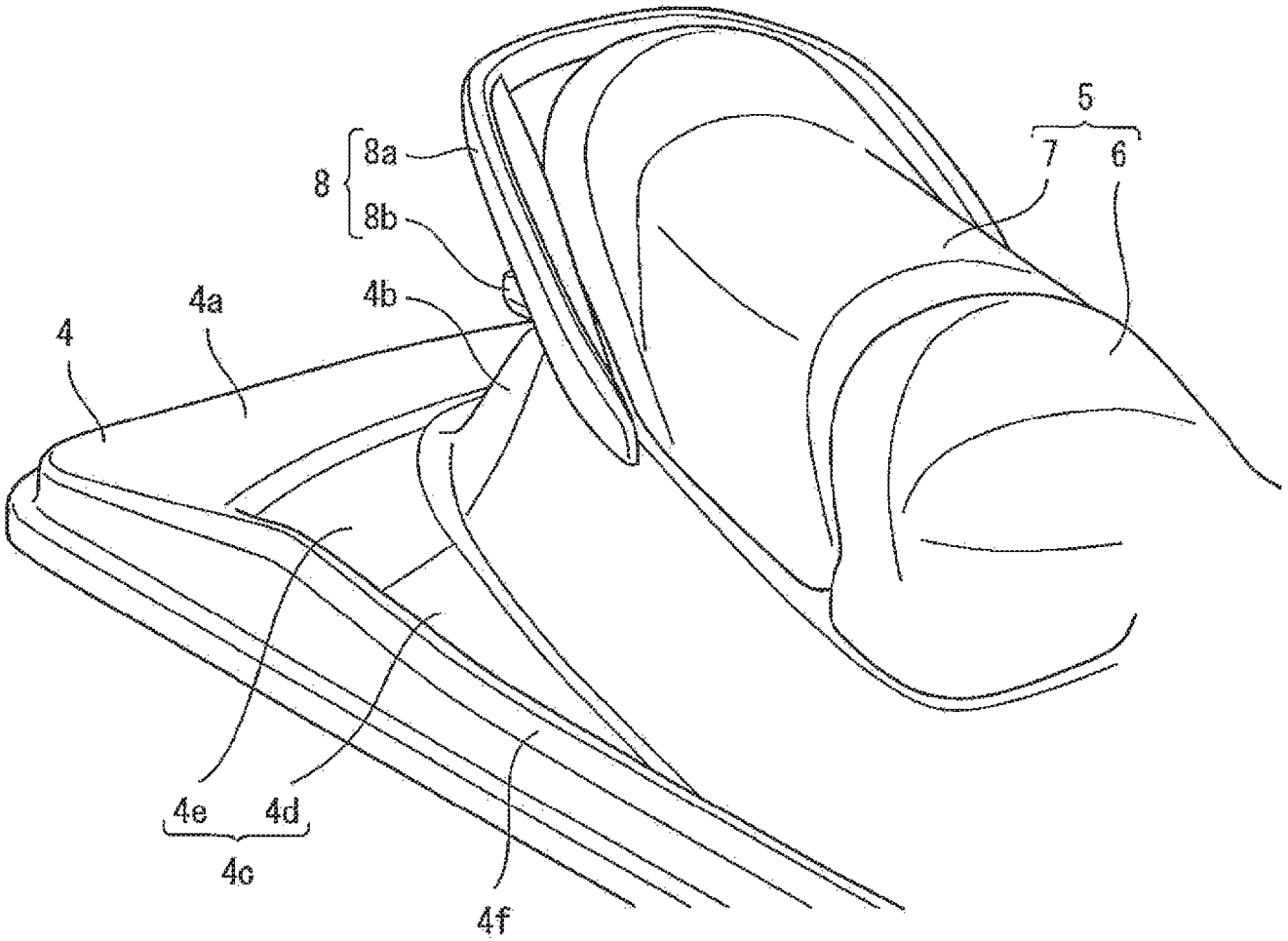
FIG. 3 is a perspective view of the rear portion of the personal watercraft of FIG. 1, when viewed from the right and the front.
Figure 4:
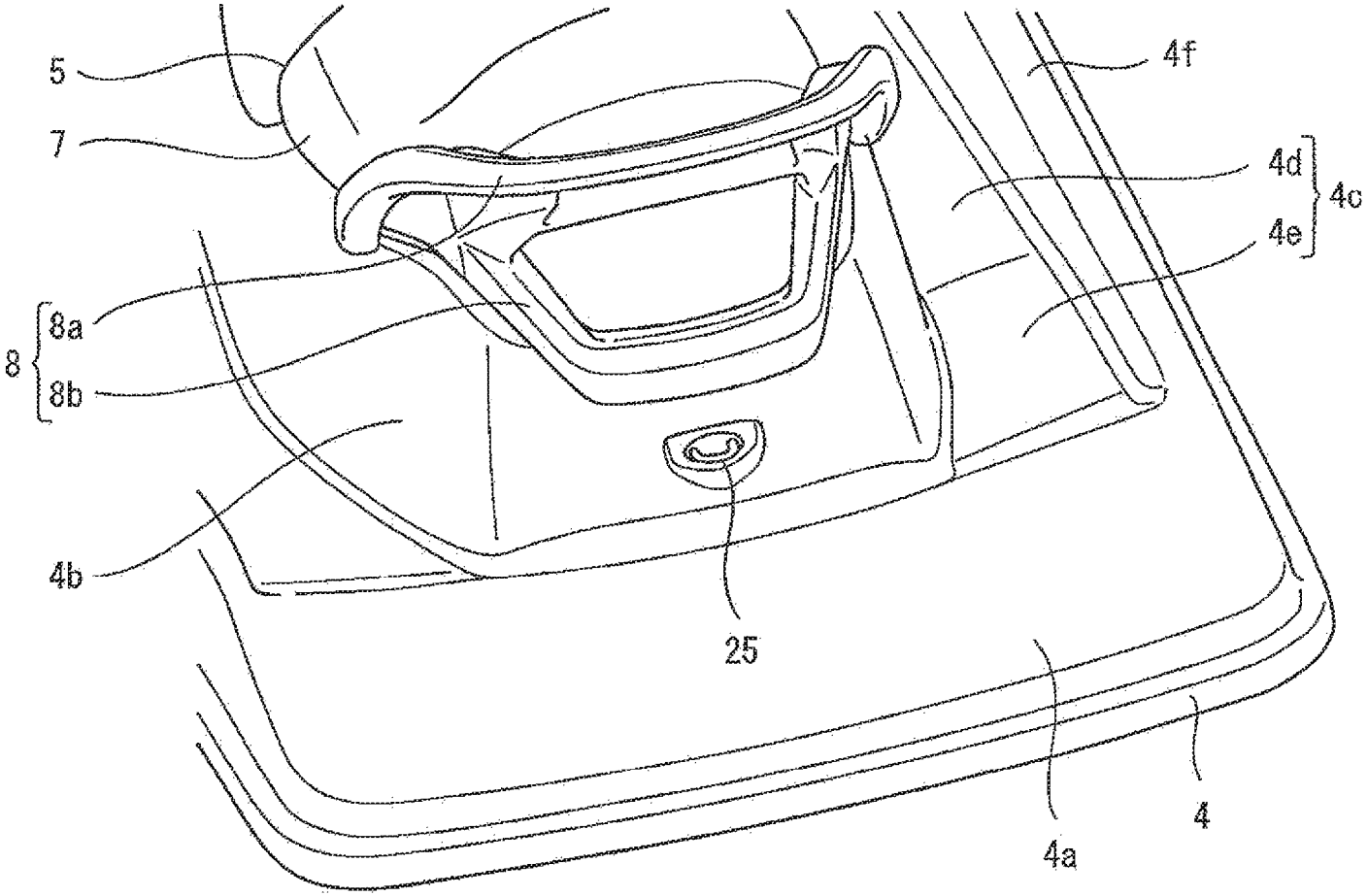
FIG. 4 is a perspective view of the rear portion of the personal watercraft of FIG. 1, when viewed from the left and the rear.

Hereinafter, the embodiment of the present invention will be described with reference to the drawings. The stated directions (forward and rearward direction and rightward and leftward direction) are from the perspective of a person (rider/and or passenger or the like) riding on a personal watercraft 1. FIG. 1 is a side view of the personal watercraft 1 according to an embodiment. FIG. 2 is a top plan view of the personal watercraft 1 of FIG. 1. FIG. 3 is a perspective view of the rear portion of the personal watercraft 1 of FIG. 1, when viewed from the right and the front. FIG. 4 is a perspective view of the rear portion of the personal watercraft 1 of FIG. 1, when viewed from the left and the rear.

Referring to FIGS. 1 and 2, the personal watercraft 1 includes a body 2, a seat 5, and a rear grip 8. The body 2 includes a hull 3 and a deck 4 covering the upper portion of the hull 3. The personal watercraft 1 includes a seat 5 on which a person (rider and/or passenger or the like) is seated in a state in which the person straddles the seat 5.

The seat 5 is disposed on the deck 4 at a location that is forward of the rear end of the deck 4. The seat 5 includes a front seat 6 and a rear seat 7. Of persons riding on the personal watercraft 1, the rider who steers the personal watercraft 1 is seated on the front seat 6. Of the persons riding on the personal watercraft 1, for example, a monitoring person (observer) who monitors (observes) a player is seated on the rear seat 7, in a case where the player plays water sport such as wakeboarding by utilizing the personal watercraft 1. In normal cases, these persons are seated on the seat 5 in a state in which they see a forward side. In a case where the player plays the water sport such as the wakeboarding, the monitoring person may be seated on the seat 5 in a state in which the monitoring person sees a rearward (backward) side.

The rear grip 8 protrudes rearward from the rear portion of the seat 5. The rear grip 8 includes a first grip part 8*a* and a second grip part 8*b* disposed below the first grip part 8*a*. The rear end of the second grip part 8*b* is located rearward of the rear end of the first grip part 8*a*.

The deck 4 includes a deck floor 4*a* and a seat support part 4*b*. The deck floor 4*a* extends in the forward and rearward direction and in the rightward and leftward direction, and is disposed laterally of the seat 5. The persons riding on the personal watercraft 1 rest their feet on the deck floor 4*a*. The seat support part 4*b* extends upward from the upper surface of the deck floor 4*a* and supports the seat 5. The rear portion of the seat support part 4*b* is inclined in an upward direction (has an upward slope), from the rear to the front. The rear portion of the seat support part 4*b* is provided with a connection member 25 used to connect a towing rope to the personal watercraft 1 in a case where the player plays the water sport such as the wakeboarding by utilizing the personal watercraft 1.

Inside the body 2, an engine E which is an example of a driving power source (prime mover) is accommodated. An output shaft 9 (crankshaft) of the engine E extends rearward in the body 2. The output end portion of the output shaft 9 is connected to a propeller shaft 11 via a coupling member 10. A water jet pump P is disposed at the rear portion of the hull 3. A propeller shaft 11 is coupled to a pump shaft 12 of the water jet pump P. The pump shaft 12 is rotatable with the rotation of the output shaft 9.

An impeller 14 is mounted on the pump shaft 12. A fairing vane 15 is disposed rearward of the impeller 14. A tubular pump casing 16 is provided at the outer periphery of the impeller 14 to cover the impeller 14.

A water intake 17 opens in the bottom portion of the body 2. The water intake 17 and the pump casing 16 are in communication with each other via a water passage 18 extending in the forward and rearward direction. A pump nozzle 19 is provided at the rear portion of the body 2 and connected to the pump casing 16. The pump nozzle 19 has a diameter reduced from the front to the rear. An ejection port opens in the rear end of the pump nozzle 19. A steering nozzle 20 is connected to the ejection port of the pump nozzle 19 such that the steering nozzle 20 is pivotable to the right and the left.

In the personal watercraft 1, by a rotational force of the impeller 14 of the water jet pump P driven by the engine E, water is taken in through the water intake 17 provided at the bottom portion of the hull 3, pressurized and accelerated to flow into the water passage 18. The resulting water flow is faired by the fairing vane 15, and a water jet is ejected in the rearward direction, from the ejection port of the pump nozzle 19 through the steering nozzle 20. As a reaction of the water jet elected from the water jet pump P through the steering nozzle 20, the personal watercraft 1 obtains a propulsive force for moving the body 2.

A steering handle bar 22 which can be gripped by the rider is provided at the front side of the deck floor 4*a*. The handle bar 22 is connected to the steering nozzle 20 via a steering cable (not shown). According to the rider's operation for tilting the handle bar 22 to the right or the left, the steering nozzle 20 is pivoted to the right or the left. Back mirrors 23 are provided in front of the handle bar 22.

A reverse bucket 24 with a bowl shape is provided in the vicinity of the steering nozzle 20. The reverse bucket 24 is rotatable around a rotational axis extending in the rightward and leftward direction. For example, by the rider's manual operation (manipulation) of a reverse lever provided under the handle bar 22, the reverse bucket 24 rotates. The reverse bucket 24 is rotatable between a forward movement position and a rearward (backward) movement position. At the forward movement position, the reverse bucket 24 is moved to and located at an upper side so that the whole of the ejection port of the steering nozzle 20 opens in the rearward direction (to the rear). At the rearward movement position, the reverse bucket 24 is moved to and located at a lower side to cover the whole of the ejection port of the steering nozzle 20 from the rear.

The reverse bucket 24 shown in FIG. 1 is at the forward movement position at which the ejection port of the steering nozzle 20 opens in the rearward direction. At the forward movement position, the reverse bucket 24 causes the water jet ejected from the steering nozzle 20 to move in the rearward direction, and thus the body 2 is moved in a forward direction. When the reverse bucket 24 is rotated to the rearward movement position at which the ejection port of the steering nozzle 20 is covered from the rear by the reverse bucket 24, the direction of the water jet ejected from the steering nozzle 20 is changed to the forward direction, and thus the body 2 is moved in the rearward direction.

As shown in FIGS. 1 and 2, when viewed from the side (in a side view), in a region of the deck floor 4*a*, the region vertically overlapping with a portion of the seat 5, the portion being rearward of a center of the seat 5 in the forward and rearward direction, inclined parts 4*c* are provided. The inclined parts 4*c* are inclined in the upward direction (have an upward slope) from the front to the rear. The inclined parts 4*c* are provided on the right and left sides of the seat 5, in the deck floor 4*a*. The inclined parts 4*c* are integrated with the deck floor 4*a*.

Each of the inclined parts 4*c* includes a first inclined part 4*d* and a second inclined part 4*e*. The first inclined part 4*d* extends in the forward and rearward direction, at a location that is lateral of the rear seat 7. The second inclined part 4*e* extends rearward from the rear end of the first inclined part 4*d*. When viewed from the side (in a side view), the second inclined part 4*e* is inclined in the upward direction (has an upward slope) from the front to the rear, at an angle larger than an angle at which the first inclined part 4*d* is inclined. The person such as the monitoring person who is seated on the seat 5 behind the rider rest feet on the first inclined parts 4*d* and the second inclined parts 4*e*. As shown in FIGS. 2 to 4, the dimension in the rightward and leftward direction, of each of the inclined parts 4*c* increases from the front to the rear. The minimum dimension in the rightward and leftward direction, of each of the inclined parts 4*c*, is much larger than the width of the person's foot.

As described above, the first inclined parts 4*d* and the second inclined parts 4*e* are inclined in the upward direction (have an upward slope) from the front to the rear. With this structure, for example, even in a case where the personal watercraft 1 is tilted such that a bow becomes higher than a stern while the personal watercraft 1 is planing on a water surface, the person can keep the feet firmly fixed on the inclined parts 4*c*, and keep the person's posture. Since the inclined parts 4*c* are provided on the right and left sides of the seat 5, and the rear grip 8 is disposed at the rear portion of the seat 5, the person can grip the rear grip 8 while keeping the feet firmly fixed on the inclined parts 4*c* provided on the right and left sides. This makes it easier for the person to take a stable posture, even in a case where the body 2 of the personal watercraft 1 being planing on the water surface is tilted in the forward and rearward direction or the rightward and leftward direction.

As shown in FIG. 1, in the present embodiment, the deck floor 4*a* includes third inclined parts 4*g* inclined in the upward direction (having an upward slope) from a location where the deck floor 4*a* vertically overlaps with the handle bar 22 toward the front ends of the first inclined parts 4*d*, and fourth inclined parts 4*h* inclined in the upward direction, from the front ends of the third inclined parts 4*g* to a location that is forward of the handle bar 22. In most cases, for example, the rider's feet rest on the third inclined parts 4*g* and the fourth inclined parts 4*h*. For example, the upper surface of the deck floor 4*a* is lowest at the front ends of the third inclined parts 4*g* (rear ends of the fourth inclined parts 4*h*).

The deck 4 includes side wall parts 4*f* extending in the forward and rearward direction, at locations that are lateral of the inclined parts 4*c*. The side wall parts 4*f* have upper ends extending smoothly from the front to the rear. The upper ends of the side wall parts 4*f* are located above the upper surfaces of the inclined parts 4*c*. As indicated by broken lines of FIG. 1, the upper surface of the deck floor 4*a* is covered by the side wall parts 4*f* from the right and the left. The side wall parts 4*f* make it possible to prevent the water from flowing into the inner side of the deck floor 4*a* from lateral sides, for example, even in a case where several persons ride on the personal watercraft 1. In some cases, the water may flow over the side wall parts 4*f* and into the deck floor 4*a*. However, the rear ends of the inclined parts 4*c* are open. Therefore, this water in the deck floor 4*a* is discharged from the rear side of the inclined parts 4*c* when the personal watercraft 1 being planing on the water surface is tilted such that the bow becomes higher than the stern, or the body 2 is accelerated.

As shown in FIGS. 3 and 4, the outer side wall surfaces of the side wall parts 4*f* are curved surfaces which extend in an upward and downward direction and in the forward and rearward direction, and are curved inward as they extend upward, while the inner side wall surfaces of the side wall parts 4*f* are flat surfaces extending in the upward and downward direction and in the forward and rearward direction. With this structure, the feet of the person can be easily put between the seat support part 4*b* and the side wall parts 4*f*. In addition, a resistance to the water in regions that are lateral of the side wall parts 4*f* can be reduced.

As descried above, in accordance with the personal watercraft 1, the monitoring person can keep the feet firmly fixed on the inclined parts 4*c* of the deck floor 4*a*, in a state in which the monitoring person is seated on a portion of the seat 5, the portion being rearward of the center of the seat 5 in the forward and rearward direction, and sees a rearward (backward) side. Thus, with a relatively simple structure, the feet of the monitoring person can be supported and the posture of the monitoring person can be kept, according to the acceleration or deceleration, or operation of the personal watercraft 1. The monitoring person can be stably seated on the seat 5.

Since the dimension in the rightward and leftward direction, of each of the inclined parts 4*c* increases from the front to the rear, the monitoring person can easily put the feet on the inclined parts 4*c* while moving the feet from the rear to the front, in a state in which the monitoring person is seated on a portion of the seat 5, the portion being rearward of the center of the seat 5 in the forward and rearward direction and sees a rearward (backward) side.

The deck 4 includes the side wall parts 4*f* extending in the forward and rearward direction, at locations that are lateral of the inclined parts 4*c*. The upper ends of the side wall parts 4*f* are located above the upper surfaces of the inclined parts 4*c*. With this structure, the feet of the monitoring person who is seated on a portion of the seat 5, the portion being rearward of the center of the seat 5 in the forward and rearward direction, and sees a rearward (backward) side, can be guided to regions each of which is between the seat 5 and the side wall part 4*f*. Therefore, the monitoring person can quickly put the feet on the inclined parts 4*c*. In addition, the side wall parts 4*f* can prevent a situation in which the feet of the monitoring person get wet in the water, while the personal watercraft 1 is planing on the water surface.

The deck 4 includes the seat support part 4*b* which extends upward from the upper surface of the deck floor 4*a* and supports the seat 5. Each of the inclined parts 4*c* is located between the seat support part 4*b* and the side wall part 4*f*. With this structure, the feet of the monitoring person who is seated on a portion of the seat 5, the portion being rearward of the center of the seat 5 in the forward and rearward direction, and sees a rearward (backward) side, can be guided to regions each of which is between the seat support part 4*b* and the side wall part 4*f*. Therefore, the monitoring person can more quickly put the feet on the inclined parts 4*c*.

The personal watercraft 1 includes the rear grip 8 protruding rearward from the rear portion of the seat 5. When viewed from the side (in a side view), the inclined parts 4*c* are placed at locations where the inclined parts 4*c* vertically overlap with the rear grip 8. The monitoring person can keep the feet firmly fixed on the inclined parts 4*c* while gripping the rear grip 8. In this way, the monitoring person can easily take a stable posture in a state in which the monitoring person sees a rearward (backward) side.

Each of the inclined parts 4*c* includes the first inclined part 4*d* extending in the forward and rearward direction, and the second inclined part 4*e* extending rearward from the rear end of the first inclined part 4*d*. When viewed from the side (in a side view), the second inclined part 4*e* is inclined in the upward direction (has an upward slope) from the front to the rear, at an angle larger than an angle at which the first inclined part 4*d* is inclined. With this structure, the monitoring person can easily keep the feet firmly fixed on the second inclined parts 4*e*. In addition, the person different from the monitoring person can easily keep the feet firmly fixed on the first inclined parts 4*d*, at a location that is forward of the monitoring person. Further, the person may put the feet on the first inclined parts 4*d* and then move the feet to the second inclined parts 4*e*. By this movement, the person who is keeping the feet firmly fixed on the inclined parts 4*c* can change the posture and can easily keep a stable structure in a state in which the person is seated on the seat 5.

Numerous modifications and alternative embodiments of the present invention will be apparent to those skilled in the art in view of the foregoing description. Accordingly, the description is to be construed as illustrative only, and is provided for the purpose of teaching those skilled in the art the best mode of conveying out the invention. The details of the structure and/or function may be varied substantially without departing from the spirit of the invention.

What is claimed is:

1. A personal watercraft comprising:

a body including a deck; and a seat disposed on the deck at a location that is forward of a rear end of the deck, wherein the deck includes a deck floor extending in a forward and rearward direction and in a rightward and leftward direction, at a location that is lateral of the seat, the deck floor further extending to include regions that are rearward of the seat, wherein when viewed from a side, inclined parts which are inclined in an upward direction from a front to a rear, are provided in regions of the deck floor, the regions vertically overlapping with a portion of the seat, the portion being rearward of a center of the seat in the forward and rearward direction, and wherein when viewed from above, the inclined parts are integrally continuous with regions of the deck floor that overlap with the seat in the forward and rearward direction and that further extend rearward of the seat.

2. The personal watercraft according to claim 1, wherein the inclined parts have a dimension in the rightward and leftward direction, which increases from the front to the rear.

3. The personal watercraft according to claim 1, wherein the deck further includes side wall parts extending in the forward and rearward direction, at locations that are lateral of the inclined parts, and wherein upper ends of the side wall parts are located above upper surfaces of the inclined parts, respectively.

4. The personal watercraft according to claim 3, wherein the deck further includes a seat support part which extends upward from an upper surface of the deck floor and supports the seat, and wherein each of the inclined parts is located between the seat support part and corresponding one of the side wall parts.

5. The personal watercraft according to claim 1, further comprising:

a rear grip protruding rearward from a rear portion of the seat, wherein when viewed from a side, the inclined parts are provided at locations where the inclined parts vertically overlap with the rear grip.

6. The personal watercraft according to claim 1, wherein each of the inclined parts includes a first inclined part extending in the forward and rearward direction, and a second inclined part extending rearward from a rear end of the first inclined part, and wherein when viewed from a side, the second inclined part is inclined in the upward direction from the front to the rear at an angle larger than an angle at which the first inclined part is inclined.

* * * * *